US007596816B1

(12) United States Patent
Henry et al.

(10) Patent No.: US 7,596,816 B1
(45) Date of Patent: Oct. 6, 2009

(54) REVERSIBLE WAISTLINE WEAR

(76) Inventors: Tyrone Oneil Henry, 2355 NW. 186th St., Carol City, FL (US) 33056; Fermin Joseph Esson, 15704 64th Pl. North, Loxahatchee, FL (US) 33470

( * ) Notice: Subject to any disclaimer, the term of this patent is extended or adjusted under 35 U.S.C. 154(b) by 0 days.

(21) Appl. No.: 12/215,010

(22) Filed: Jun. 24, 2008

(51) Int. Cl.
*A41D 1/06* (2006.01)
*A41D 1/00* (2006.01)

(52) U.S. Cl. ..... 2/227; 2/228; 2/238; 2/400; 2/69; 2/DIG. 2

(58) Field of Classification Search ..... 2/227, 2/228, 238, 400–408, 79, 236, 237, 220, 2/221, 69
See application file for complete search history.

(56) References Cited

U.S. PATENT DOCUMENTS 542,891 A 7/1895 Hoyt
4,447,911 A 5/1984 Marcellaro
4,561,121 A * 12/1985 Ehring et al. ..... 2/455
5,010,595 A * 4/1991 Stradley ..... 2/227
5,168,582 A * 12/1992 Aldridge ..... 2/305
5,689,832 A * 11/1997 Head ..... 2/227
6,202,220 B1 * 3/2001 Rhoden ..... 2/236
6,243,880 B1 * 6/2001 Lyden ..... 2/228
6,308,338 B1 10/2001 Caldwell
6,789,269 B1 9/2004 Scovin
6,922,849 B1 * 8/2005 Fedrick ..... 2/227
7,124,448 B2 * 10/2006 Davenport ..... 2/229
D552,328 S 10/2007 Smith et al.
D562,532 S 2/2008 Brown, Jr.

* cited by examiner

*Primary Examiner*—Gloria Hale
(74) *Attorney, Agent, or Firm*—Carol N. Green, Esq.

(57) ABSTRACT

The present invention is directed to reversible pants which can be worn in a conventional manner on the wearer's true waist with the added capability of being reversed to showcase a second side to simulate the fashion trend wherein the underwear is seemingly exposed above the pants' waistline, with the waistline dropped below the conventional waist and hips of the wearer.

12 Claims, 2 Drawing Sheets

REVERSIBLE WAISTLINE WEAR

FIELD OF THE INVENTION

The present invention is directed to reversible pants which can be worn in a conventional manner with the capability of being reversed to simulate the fashion trend wherein the underwear is seemingly exposed above the pants waistline, with the waistline dropped below the conventional waist and hips of the wearer.

BACKGROUND OF THE INVENTION

The style of wearing one's jeans below the wearer's true waist with the underwear intentionally visible has gained much popularity among a wide cross section of the public, which includes teens, young adults, roller bladers and other athletes, alike. Despite its wide popularity, many conservatives remain unconvinced that this fashion trend is here to stay and in response some cities have chosen to crack down on this fashion trend by criminalizing the act of wearing one's jeans below the waistline. Thus, there exists a need for the wearer to be able to exhibit their own personal fashion style without violating the law.

This fashion trend is not cheap as the wearer has to pay particularized attention to both the jeans and the underwear being exposed, which necessarily must be attractive and of good quality. The jeans consume a lot of fabric to accomplish the baggy, dropped waistline look and so it is not uncommon for these jeans to cost significantly more than a regular pair of fitted jeans or slacks because of the additional fabric being used. Parents or individuals who try to accommodate this fashion trend may find it costly, and in certain instances cost prohibitive to own multiple pairs. Thus, there exists a need for this fashionable ware to be affordable.

Sometimes the wearer experiences difficulty securing the pants below the waistline as the fabric used for the underwear may not be suitable for sustaining the heavier jeans fabric. As such, the jeans tug on the waistline of the underwear causing the wearer to expose more skin than intended. Thus, there exists a need to properly secure the underwear to the wearer's waistline in a manner that can sustain the heavier jeans material without compromising the style and comfort of the wearer.

SUMMARY OF THE INVENTION

The present invention is directed to solving the various problems enumerated above, in a new, novel and useful manner.

In view of the foregoing background of the invention, it is therefore an object of the present invention to provide a pair of reversible pants that allows the wearer to wear their pants in a conventional manner, and obtain extended use.

Another object of the invention is to provide pants that can showcase the current fashion trend of wearing a pant below the true waistline and or hips without violating the law.

It is also an object of the present invention to provide fashionable alternative wear that is affordable to the public at large.

Another object of the invention is to provide reversible pants that can be configured to be worn as shorts or full length pants.

These and other objects, features, and advantages of the present invention are provided by a pair of reversible pants configured to provide the illusion of the wearer's underwear being intentionally exposed above the true waistline and where the pants' waistline appears to be below the wearer's hips. Said pants are constructed with reversible front and rear panels (right and left) that depend from a first waistline and are seamingly joined to the first waistline via joining means, e.g. stitches, or other well known joining means as used in the arts. On one side of the reversible pants, the front and rear panels are configured such that the front panels can be joined with the rear panels to showcase a conventional pair of pants capable of being worn in a conventional manner with the waistline of the reversible pants being worn on the wearer's waist or slightly below the waist on the top of the hips where the underwear is hidden from public view. The front panels are of extended length with sufficient fabric to accommodate pockets or pleats or any other conventional accommodations that are well known and used in the arts. Similarly, the rear panels are of extended length to accommodate the baggy, dropped waistline look on the reverse side.

The reverse side of each front panel of the reversible pants is provided with front and rear panel inserts that depend from the reversible pants' first waistline where it is secured by joining means to both the first and second waistline and is otherwise proportioned to fit below the wearer's buttocks. Said front and rear panel inserts are made from material generally suitable for underwear, e.g. boxers or any other fabric that is well known and used in the arts that could be used to simulate this fashion trend. Extending from the second waistline are front and rear panels that are configured to provide the illusion that a pair of jeans are disposed below the wearer's buttocks, are otherwise proportioned in length to mimic the baggy, dropped waistline look, and wherein said front and rear panels overlap at the primary opening to accommodate the closing means, e.g. zippers, buttons, etc.

To accomplish the various objectives of the invention, the structure and arrangement of the various components will be evident from the description below, the within specification, drawings and the following claims.

For a further and more fully detailed understanding of the present invention, various objects and advantages thereof, reference is made to the following detailed description and the accompanying drawings.

BRIEF DESCRIPTION OF THE DRAWINGS

Further objectives and advantages of the present invention may be derived by referring to the detailed description and claims when considered in connection with the Figures, wherein like reference numbers refer to similar items throughout the Figures.

DESCRIPTION OF PREFERRED EMBODIMENTS

The present invention is now described in more detail by reference to the exemplary drawings in detail wherein like numerals indicate like elements throughout the various views. This is for convenience only and is not intended to limit the application of the present invention. In fact, after reading the following description, it will be apparent to one skilled in the relevant art(s) how to implement the following invention in alternate embodiments.

Figure 1:
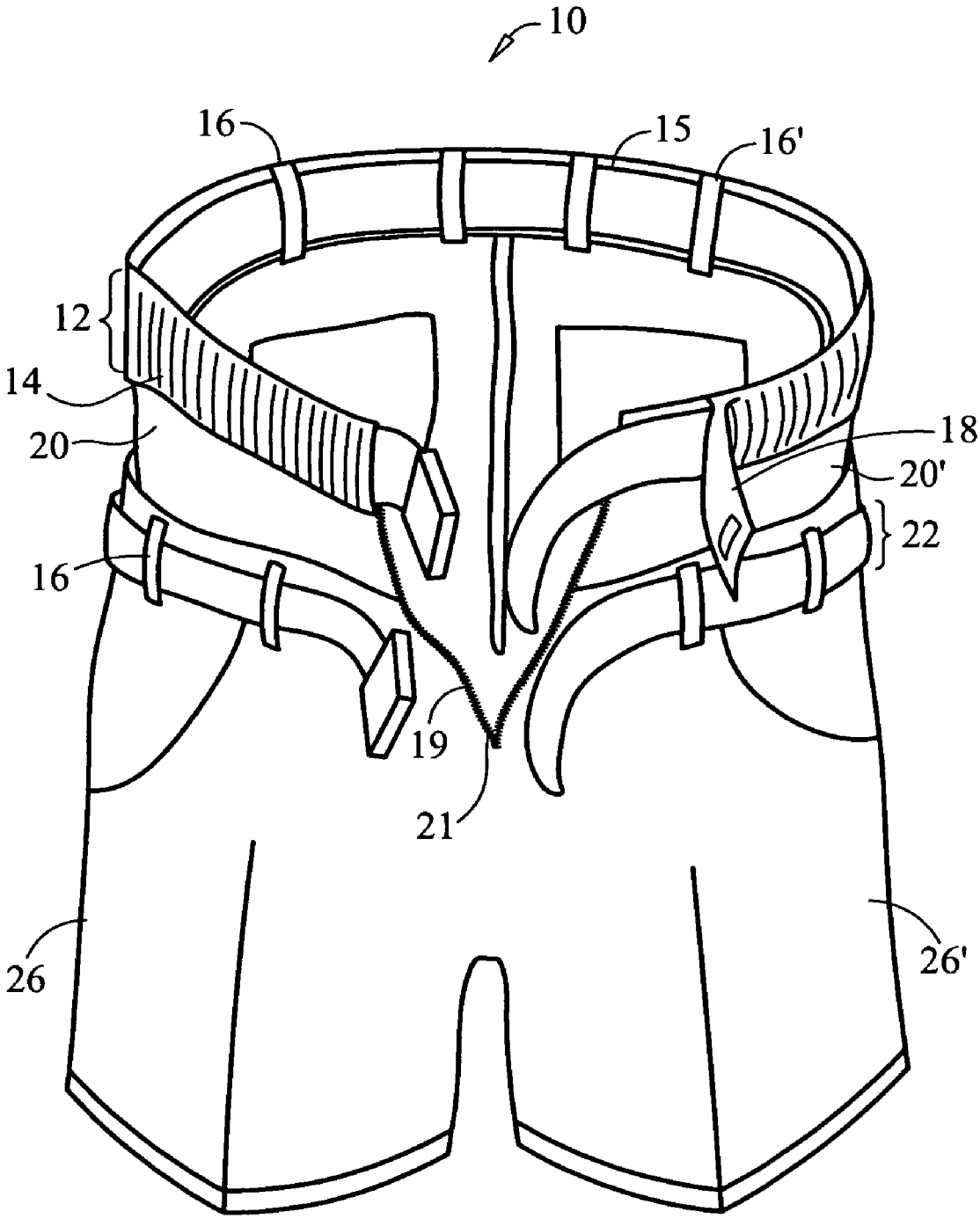
FIG. 1 is a front view of the invention.

FIG. 1 is a front view of the reversible pants 10 depicting one embodiment of the invention wherein the underwear seemingly appears to be intentionally visible, and is disposed above the first waistline 12 of the reversible pants 10. As shown in FIG. 1, the reversible pants 10 provides for a first side 11 with a first waistline 12 to be worn and secured on the wearer's, waist. The first waistline 12 is provided with a waistband 23 (not shown) which is further provided with a concealed panel 14 that is sufficiently broad enough to encompass a belt, such that a belt may be inserted therein to encircle and secure the reversible pants 10 to the wearer's waist. In this embodiment, the reverse side 15 of the concealed panel 14 is otherwise open with a plurality of spaced loops 16 for guiding a belt to be looped therein. When a belt has been looped through the concealed panel 14, the belt remains mostly visible on the reverse side 15 of the concealed panel 14, but hidden from the public's view. Accordingly, the wearer seemingly appears to have his underwear exposed above their slacks or jeans (collectively "jeans), when in reality their jeans are being worn on the wearer's waist in conformity with the law.

Said concealed panel 14 is made from material suitable for underwear, like boxer shorts that may be reinforced with securing means 17 (not shown) for securing the waistline of underwear to the wearer's waist. Said securing means may include stitching, gathering, elastic, or other well known securing means as used in the arts. The concealed panel 14 further provides for a flap 18 disposed adjacent to the primary opening 19 of the reversible pants 10 which accommodates the reversible pants' 10 closing means 21 (e.g. zippers or buttons with buttonholes (not shown), or any other closing means 21 that are well known and used in the arts). Said flap 18 comprises of similar fabric used for the concealed panel 14, and extends therefrom such that it covers and conceals from the public's view any belt being used to secure the first waistline 12 of the reversible pants 10.

In this embodiment, the reversible pants 10 further provides front and rear panel inserts 20, 20', 20", 20'", also made of the same material as the concealed panel 14, that depend from the first waistline 12 extending therefrom to the second waistline 22. The front and rear panel inserts 20, 20', 20", 20'" are secured by joining means to the first 12 and second waistlines 22, and is proportioned to cause the second waistline 22 to fit below the wearer's buttocks. The front and rear panel inserts 20, 20', 20", 20'" are configured to mimic the upper portion of a pair of underwear e.g. boxer shorts, such that the right and left rear panel inserts 20", 20'" are seamingly joined in the middle and are each in mating engagement with the sides of the front panel inserts 20, 20' joined together by joining means in the conventional manner. The right and left front panel inserts 20, 20' necessarily overlap in the front using closing means 21 that are well known and used in the arts, e.g. snaps and fasteners, buttons and buttonholes, etc., to close the front panel inserts 20, 20' where they meet at the primary opening 19.

The second waistline 22 is made from a contrasting fabric, preferably jeans material or other like materials. The second waistline 22 is provided with a waistband 23 (not shown) comprising of a plurality of spaced loops 16 for a belt to be slideably guided through to maintain the illusion that the belt on the second waistline 22 is being used to secure the reversible pants 10. The wearer can opt not to wear a belt through the second waistline 22 and still be secured, as the reversible pants 10 is already secured to the wearer's waist via the belt looped through the first waistline 12 in the concealed panel 12.

The second waistline 22 is in mating engagement with the front 26, 26' and rear panels 28, 28' which depend therefrom, and are joined with it via conventional joining means. Said front 26, 26' and rear panels 28, 28' (not shown) are also configured to provide the illusion that a pair of jeans is disposed below the wearer's buttocks, and are otherwise proportioned in length and width to mimic the baggy, dropped waistline look. Similar to the front and rear panel inserts 20, 20', 20", 20'", the right and left front panels 26, 26' overlap at the primary opening 19 to accommodate the closing means 21.

Although FIG. 1 depicts an embodiment of the invention as a pair of shorts, it is understood that the front 26, 26' and rear panels 28, 28' may be configured with additional material to extend the front 26, 26' and rear panels 28, 28' such that the invention can be worn as capris, mid calf reversible pants, or a long pair of pants, or any other variations in length that the wearer desires. Similarly, FIG. 2 depicts the short form of an embodiment of the invention but is by no means intended to be a limitation on the invention and the varied lengths that the reversible pants 10 can be configured for wearing.

Figure 2:
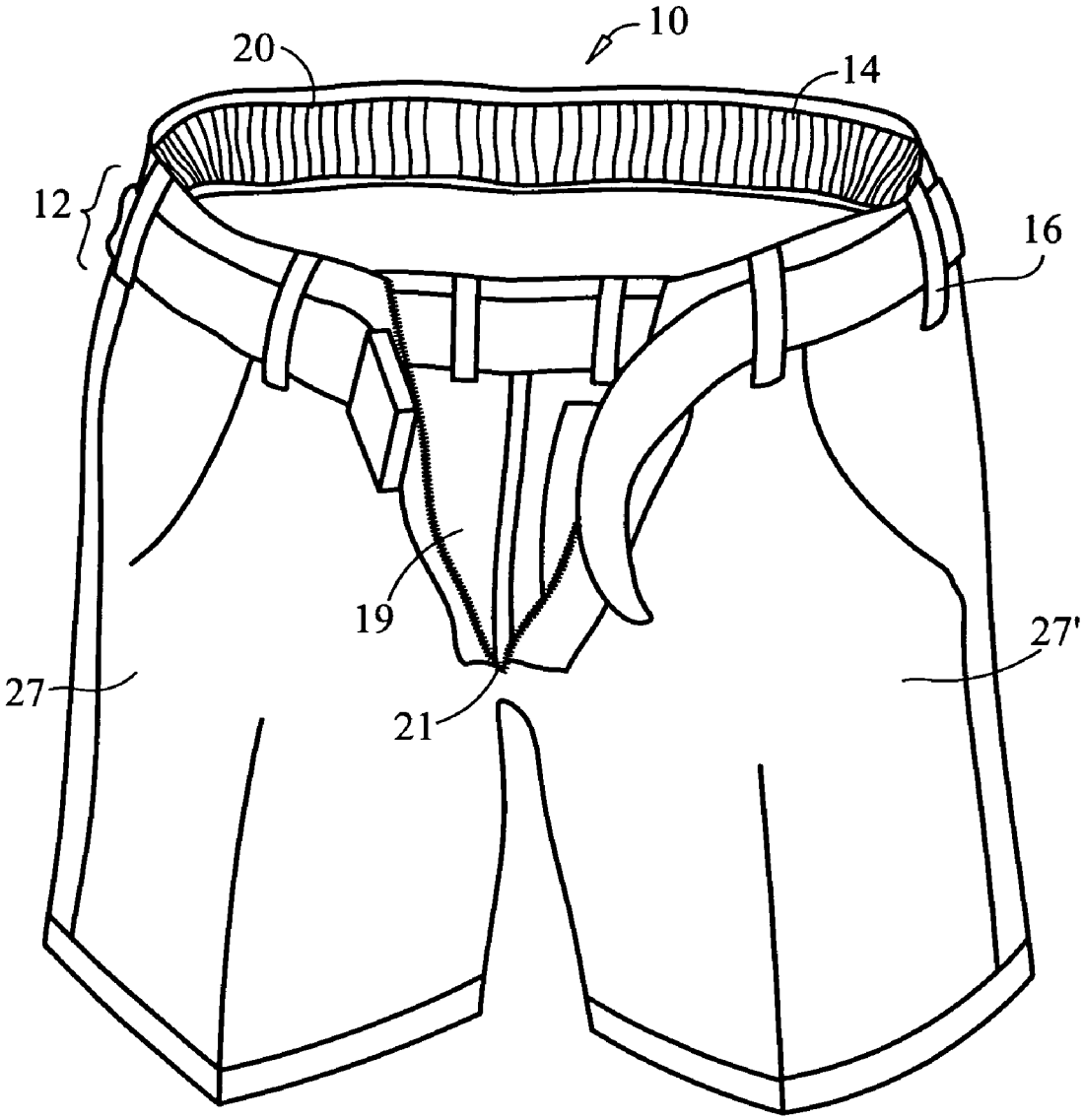
FIG. 2 is a front perspective view of the second side of the invention.

FIG. 2 is a front perspective view of the second side 30 of the invention. Here, the second side 30 of reversible pants 10 is the reverse of the first side 11 which provides for a conventional pair of pants provided with a first waistline 12, a waistband 23 (not shown) with a plurality of loops 16, and from which the right and left conventional front panels 27, 27' as well as the right and left conventional rear panels 29, 29' depend therefrom. Said second side 30 of the reversible pants 10 further includes a primary opening 19 with closing means 21 to keep undergarments hidden from external view.

As shown in FIG. 2, the second side 30 showcases a conventional pair of pants where the first waistline 12 remains on the wearer's waist or slightly below on the hips. Thus, the concealed panel 14, the fabric insert 20 and the second waistline 22 all remain invisible from external view and there is no appearance or semblance of intentionally exposed underwear being worn above the jeans. Thus by using the invention as described, the wearer may obtain multiple wear from the same reversible pants 10 without being obvious.

Other modifications and implementations will occur to those skilled in the art without departing from the spirit and the scope of the invention as claimed. Accordingly, the invention is to be defined not only by the preceding illustrative description but also by the following claims.

What is claimed is:

1. A pair of reversible pants comprising of:

(a) pants capable of being worn in a conventional manner with a waistline of the reversible pants being worn on a wearer's waist, and alternatively reversed to simulate the underwear being seemingly exposed above a pants waistline, with the waistline seemingly dropped below the conventional waist or hips of the wearer;

(b) a first side with a first waistline to be secured on the wearer's waist which is provided with a concealed panel and a plurality of spaced loops on the reverse side of said concealed panel for guiding a belt, such that when looped therein the belt secures the reversible pants to the wearer's waist and will remain hidden from public view but is otherwise mostly visible on the reverse side of the concealed panel;

(c) front and rear panel inserts that depend from the first waistline of the first side, extending therefrom to the second waistline, and wherein the front and rear panel inserts are configured to mimic the upper portion of a pair of underwear and are otherwise proportioned to cause the second waistline to fit below the wearer's buttocks;

(d) a second waistline of the first side, that is provided with a waistband comprising of a plurality of spaced loops for a belt to be slideably guided through to maintain the illusion that the belt on the second waistline is being used to secure the reversible pants to the wearer's waist;

(e) front and rear panels of the first side, that depend from the second waistline and are configured to provide the illusion that a pair of jeans are disposed below the wearer's buttocks, are otherwise proportioned in length to mimic the baggy, dropped waistline look, and wherein said front and rear panel overlap at the primary opening to accommodate the closing means; and (f) a second side with conventional front and rear panels capable of being worn in a conventional manner with the waistline of the reversible pants being worn on the wearer's waist.

2. The concealed panel of claim 1, further comprising of a flap disposed adjacent to a primary opening of the reversible pants, for concealing the belt looped within the concealed panel.

3. The second waistline of claim 1, further comprising of a waistband with a plurality of loops for a belt to be slideably guided through.

4. The right and left front panel inserts of claim 1, further comprising of closing means.

5. The closing means of claim 4 comprising of snaps and fasteners.

6. The closing means of claim 4 comprising of buttons and buttonholes.

7. The closing means of claim 4, comprising of zippers.

8. The right and left front panels of claim 1, further comprising of closing means.

9. The closing means of claim 7, comprising of snaps and fasteners.

10. The closing means of claim 7, comprising of buttons and buttonholes.

11. The closing means of claim 7, comprising of zippers.

12. The second side of claim 1, further comprising of a first waistline, a waistband from which conventional front and rear panels depend therefrom which are of extended length and wherein said second side further includes a primary opening for the wearer to wear the reversible pants to be closed using closing means.

* * * * *